US008136695B2

(12) United States Patent
De Jong et al.

(10) Patent No.: US 8,136,695 B2
(45) Date of Patent: Mar. 20, 2012

(54) CASSETTE FOR A TOWEL DISPENSER AND TOWEL DISPENSER FOR USE OF SUCH A CASSETTE

(75) Inventors: Theodor Robbert Marie De Jong, Hoeven (NL); Oscar Toetenel, Rotterdam (NL)

(73) Assignee: Vendor B.V., Tilburg (NL)

( * ) Notice: Subject to any disclaimer, the term of this patent is extended or adjusted under 35 U.S.C. 154(b) by 738 days.

(21) Appl. No.: 12/209,533

(22) Filed: Sep. 12, 2008

(65) Prior Publication Data

US 2009/0066199 A1 Mar. 12, 2009

(30) Foreign Application Priority Data

Sep. 12, 2007 (NL) ..... 1034374

(51) Int. Cl.
*B65H 7/00* (2006.01)

(52) U.S. Cl. ..... 221/11; 221/13; 312/34.4; 312/34.8

(58) Field of Classification Search ..... 221/11, 221/13, 14; 312/34.1–34.17
See application file for complete search history.

(56) References Cited

U.S. PATENT DOCUMENTS

| | | | | | |
|---|---|---|---|---|---|
| 1,721,928 | A | * | 7/1929 | Steiner | 312/34.11 |
| 1,756,766 | A | | 4/1930 | Steiner | |
| 1,860,206 | A | * | 5/1932 | Schwartz | 312/34.6 |
| 2,772,133 | A | | 11/1956 | Birr | |
| 3,140,904 | A | | 7/1964 | Preston | |
| 4,915,993 | A | | 4/1990 | Ten Wolde | |
| 6,007,168 | A | * | 12/1999 | Gaide | 312/34.6 |
| 2003/0201274 | A1 | | 10/2003 | Taylor | |
| 2005/0189850 | A1 | * | 9/2005 | Riel | 312/34.4 |

FOREIGN PATENT DOCUMENTS

| | | | | |
|---|---|---|---|---|
| EP | 288211 | A1 | * | 10/1988 |
| JP | 60144272 | A | * | 7/1985 |
| WO | WO 02/098268 | | | 12/2002 |
| WO | WO 2006/065515 | A | | 6/2006 |

* cited by examiner

*Primary Examiner* — Mark A Deuble
(74) *Attorney, Agent, or Firm* — Weingarten, Schurgin, Gagnebin & Lebovici LLP

(57) ABSTRACT

The invention relates to a strip of towel material for use in a towel dispenser, which strip has a longitudinal direction and a transverse direction and has been wound onto a roller, or has been folded along folding lines extending in the transverse direction and spaced apart in the longitudinal direction, such that a stack has been obtained, wherein the strip is provided with at least one electronically readable marking.

22 Claims, 14 Drawing Sheets

CASSETTE FOR A TOWEL DISPENSER AND TOWEL DISPENSER FOR USE OF SUCH A CASSETTE

This application claims priority to Dutch Appln. No. NL 1034374 filed Sep. 12, 2007.

The invention relates to a cassette for a towel dispenser. The invention further relates to a towel dispenser for use of such a cassette and an assembly of such a towel dispenser and cassette.

Cassettes of towel material are known for use in a towel dispenser.

In towel dispensers, usually a waiting time is set. That is the time a user must wait between a first time of feeding-through towel material and a next, second time of feeding-through towel material. For different uses, different waiting times may be advantageous. A manager of a towel dispenser will set this waiting time, for instance, to be preferably relatively long, because this will to a large extent prevent a user from feeding-through towel material two or more times while drying his hands. A user will appreciate a short waiting time because he then has relatively much towel material at his disposal in a short time. In some cases a manager can also have an interest in a short waiting time, for instance to offer users, such as clients, much convenience. In towel dispensers, usually also the loop length can be set. The loop length is defined by the length of towel material that is presented to a user for drying for instance his hands. Depending on, for instance, the setting of the towel dispenser, a part of the loop or the whole loop may be replaced after each use.

The invention provides towel material provided with a marking which allows a towel dispenser with the aid of a sensor to recognize the towel material. This affords the possibility of setting the towel dispenser on the basis of the towel material or at any rate the marking. This allows setting of, for instance, the waiting time, the loop length, the length of towel material taken in after each use, or other quantities related to towel material.

Recognition of towel material should herein be understood to mean at least, though not exclusively, recognition of the marking as such which is provided on or in the towel material, such that in relation thereto a setting of a towel dispenser can be determined.

Furthermore, a towel dispenser is provided in which a sensor is included which allows at least one marking on or in the towel material to be read, while a control unit is provided which allows the towel dispenser to be set on the basis of at least one marking. Preferably, the sensor is arranged for contactlessly reading of the at least one marking, more particularly contactlessly and without use of light. As a result, for instance fouling of the sensor and/or of the marking, for instance with dust, fiber material of the towel material, or the like, will not affect the reading of the marking. Preferably, the sensor does not comprise any moving parts for the purpose of reading.

Reading of a marking is herein understood to mean at least, though not exclusively, establishing of the presence of a marking by the sensor or recognition of a pattern of a marking by the sensor, or recognition of for instance a pattern of successive markings on or in the towel material.

Different strips of towel material may be provided in a set, while within the set a number of different strips may be provided with a number of different markings, so that when these strips are used in one and the same towel dispenser, the towel dispenser will be set differently under the influence of the different markings.

A towel dispenser according to the invention may be provided with a control unit in which setting possibilities are provided for functionalities of the towel dispenser, such as loop length, waiting times, dispensing patterns and the like, in conjunction with markings on towel material. In this way, it can be set per towel dispenser how the setting of the towel dispenser will change under the influence of different markings, so that for instance different towel dispensers with the same or comparable sensor and control unit can be set differently by a same marking or can be set equally by different markings, depending on the preferences set in the control unit. However, it is also possible to choose a standard setting, so that equal or comparable towel dispensers will always be set in the same manner by the same markings.

In clarification, embodiments of a towel dispenser and of cassettes of a towel dispenser will be further elucidated with reference to the drawing. In the drawing:

FIG. 8 shows a wholly filled cassette holder, in front and partly sectional side elevation, with the contours of a cassette drawn in;

Figure 1:
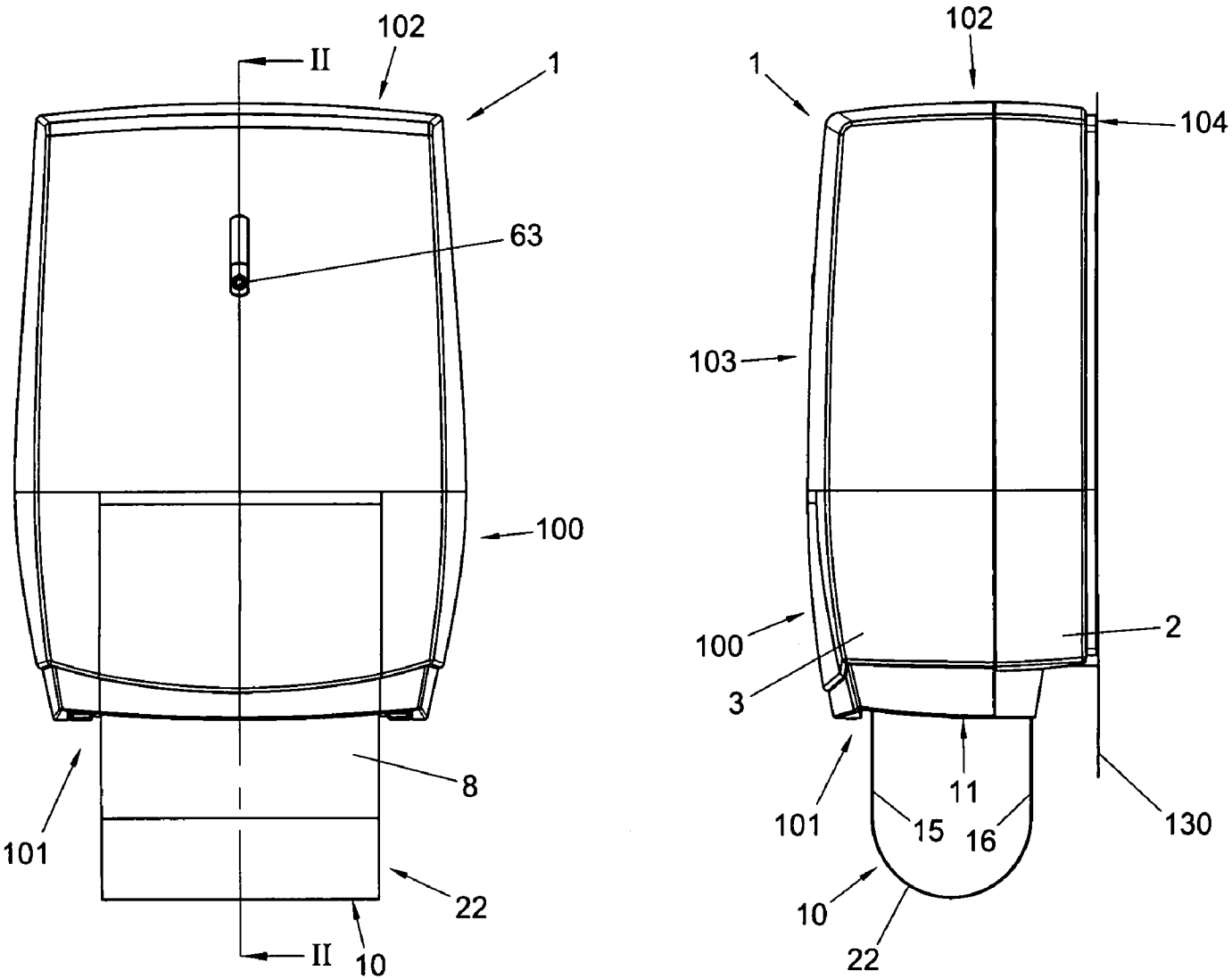
FIG. 1 shows in front and side elevation a towel dispenser, in closed condition.

The invention is not limited in any way to the embodiments shown in the description and the drawings. Many variations thereon are possible within the framework of the invention outlined by the claims. In the different figures and embodiments, equal or corresponding parts have equal or corresponding reference numerals.

In the figures, what will be designated as bottom side 101 of a towel dispenser is the side where, or in the neighborhood of which, during normal use, towel material is dispensed. Designated as top side 102 is the opposite side. Designated as the front side 103 is the side facing a user of the towel dispenser in closed condition during normal use; the rear side 104 is the side facing away from the user.

Figure 2:
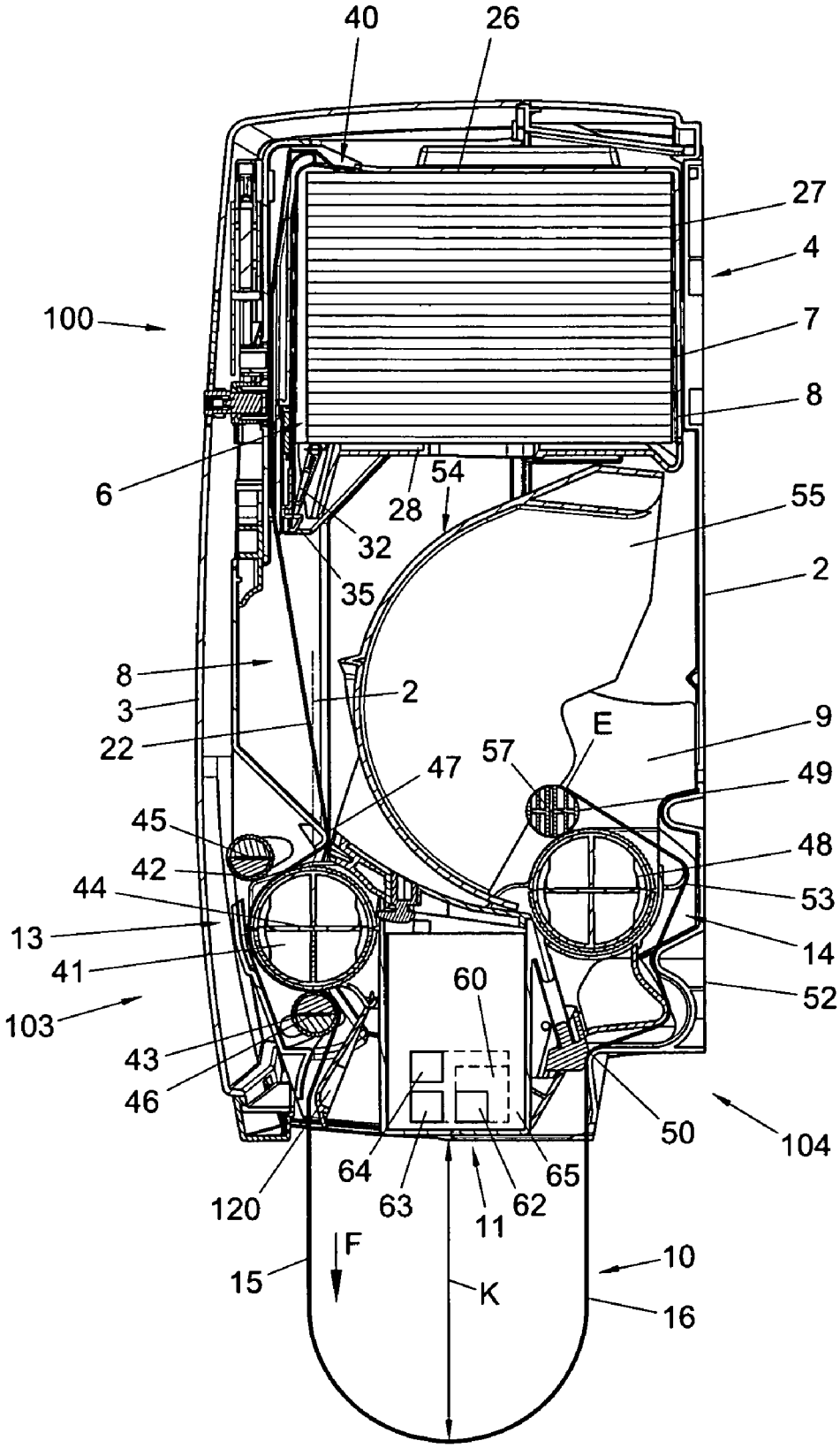
FIG. 2 shows in sectional side elevation a towel dispenser along the line II-II in FIG. 1.

FIGS. 1 and 2 shows a general set-up of a towel dispenser 1, in closed condition. The towel dispenser 1 has a housing 100 which has a back part 2 and, movably connected therewith, a cover part 3. The back part 2 is preferably provided with means for suspending the towel dispenser 1 from for instance a wall 130. These means can for instance comprise openings 4 for screws or other means known per se. Optionally, an extra suspension means may be used, such as a bracket which may be mounted against a wall, from which the towel dispenser can then be suspended. Within the housing 100, receiving means 6, to be further specified hereinafter, are provided for placing a cassette 7 of clean towel material 8 and preferably collecting means 9 for receiving used towel material 8, especially when the towel dispenser 100 is arranged for dispensing towel material 8 in a loop 10. In FIGS. 1 and 2 such a loop 10 is represented at the underside 11 of the towel dispenser 100. A strip 22 of towel material 8 is represented in FIG. 2 as a solid line from the receiving means 6, via a drive and/or brake mechanism 13 to the underside 11, where the loop 10 is formed, with the strip 22 having then been passed via further guide means 14 to the collecting means 9.

During use, as for instance when managing the apparatus, prior to or during drying of the hands or possibly autonomously controlled by the apparatus, towel material 8 can be dispensed by the apparatus to the part 15 of the loop 10, facing the front side 103, while a preferably approximately equal amount of towel material 8 of the part 16 of the loop 10, facing the rear side 104, can be taken in and can be collected, for instance rolled up in the collecting means 9. Dispensing and intake of towel material 8 can for instance be achieved manually, by pulling down the front part 15, in the direction F, and/or in a motor-driven manner, for instance by driving the drive and/or brake means 13 for some time. To that end, a contact switch may be provided, operable by a user or by exertion of a force F, and/or by a proximity switch, for instance a motion sensor, heat sensor, presence sensor or like switches known per se capable of sensing the proximity and/or presence of a user or for instance a hand near the bottom side 105 and on the basis thereof dispensing clean towel material 8.

Figure 3:
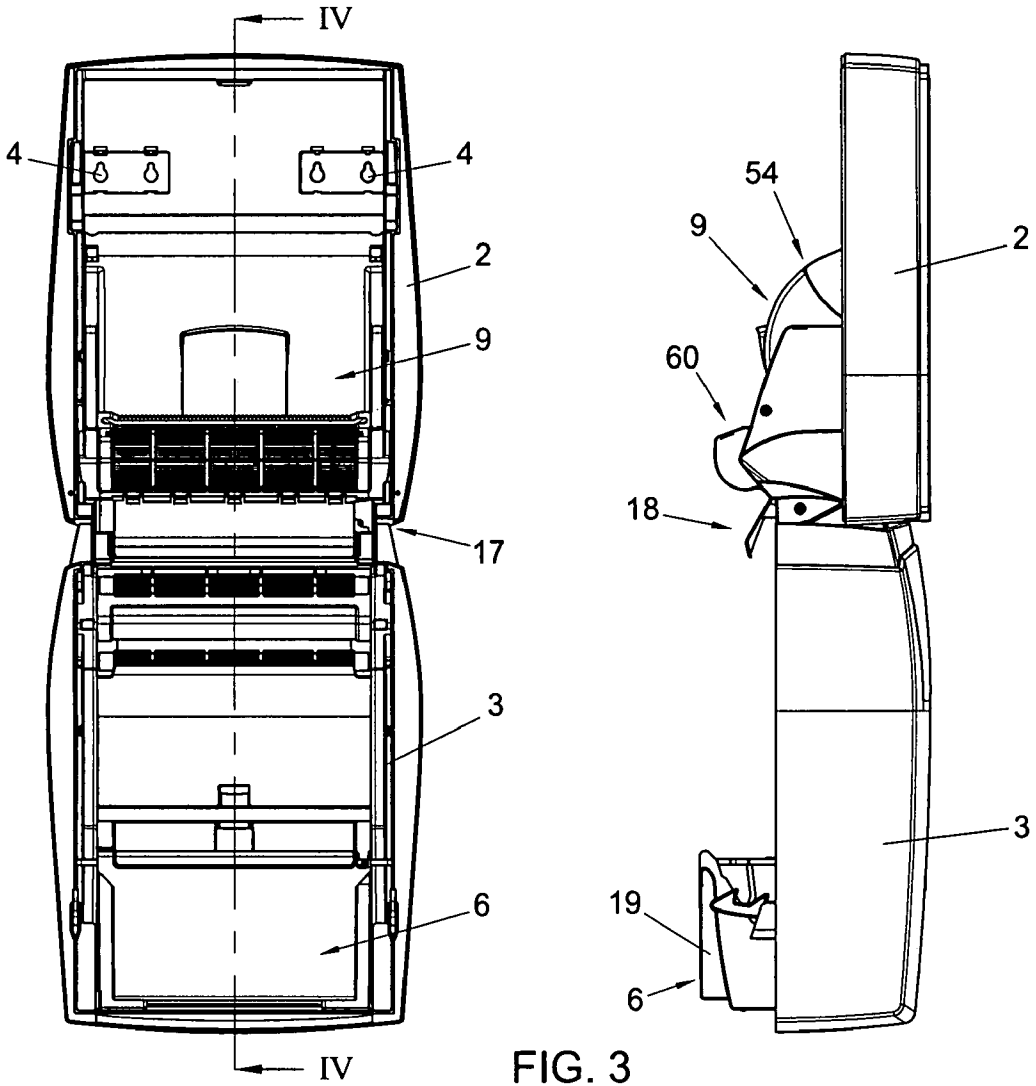
FIG. 3 shows in front and side elevation a towel dispenser in open condition.
Figure 4:
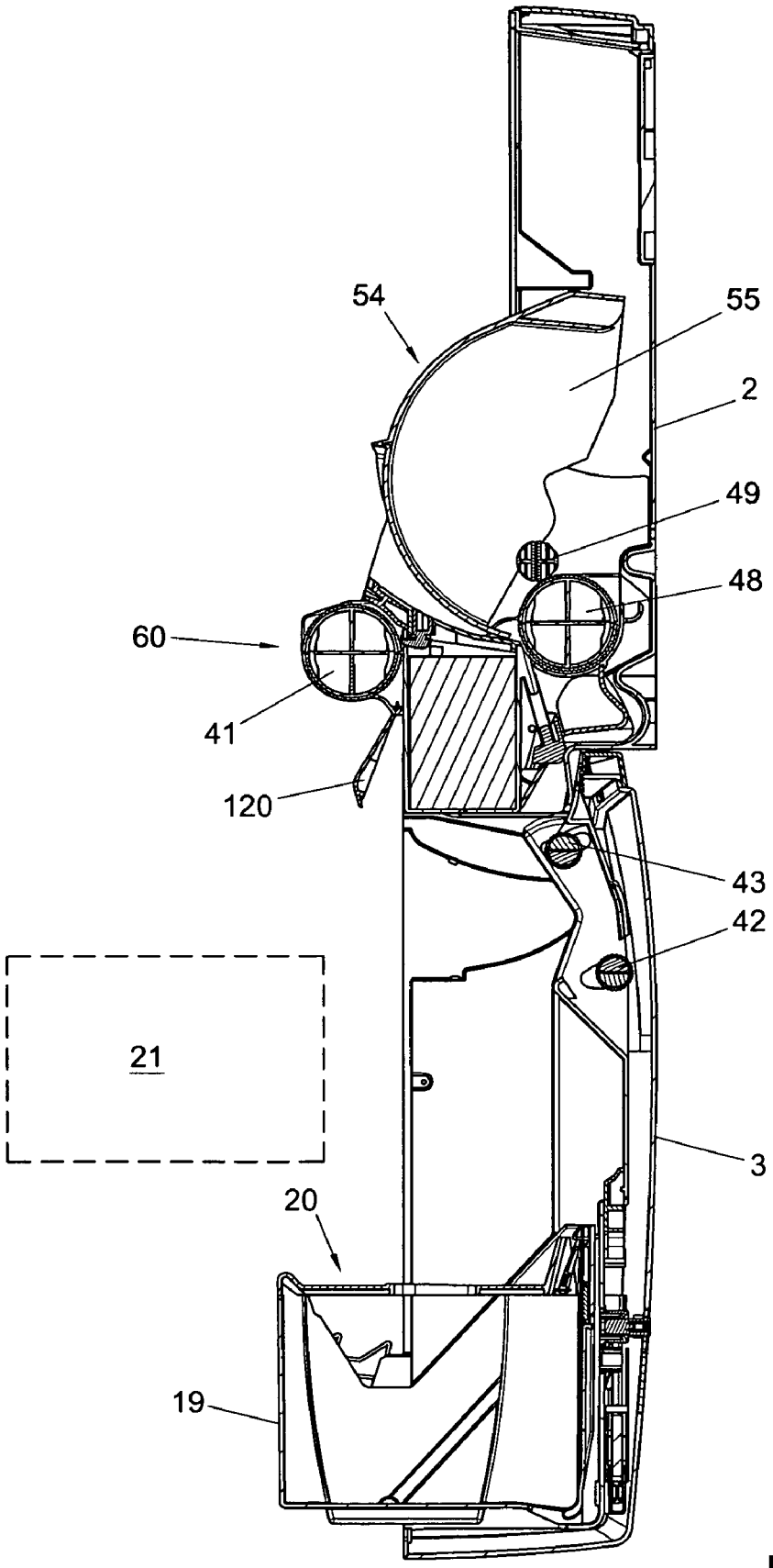
FIG. 4 shows in partly sectional side elevation a towel dispenser along the line IV-IV in FIG. 3.

In FIGS. 3 and 4, a towel dispenser 1 is represented in open condition. The cover part 3 is coupled with the back part 2 via a pivot 17, which pivot 17 is arranged near the bottom side 105. The cover part 3 can therefore be pivoted down from the closed position as shown in FIGS. 1 and 2 to the open position in FIGS. 3 and 4. In this opened position, the inner work 18 of the towel dispenser 1 is accessible. As is clearly visible in FIGS. 3 and 4, the receiving means 6, which in the closed position of the towel dispenser 1 are situated at the top side 101, have pivoted down along with the cover part 3 and are situated, in the open position, approximately at the lowest point of the dispenser, for instance lower than where in the position of use in FIGS. 1 and 2 the bottom side of the back part 2 is situated. The receiving means 6 comprise a cassette holder 19 which in the open position of the towel dispenser is provided at the top thereof with a filling opening 20 through which a cassette 21 of towel material 8 can be placed. Upon closing of the towel dispenser 1, the cassette holder 19 with the cassette 21 will be moved up to a position in the top of the towel dispenser 1, above the collecting means 9, while the filling opening 20 may thereby be directed downwards.

Figure 7:
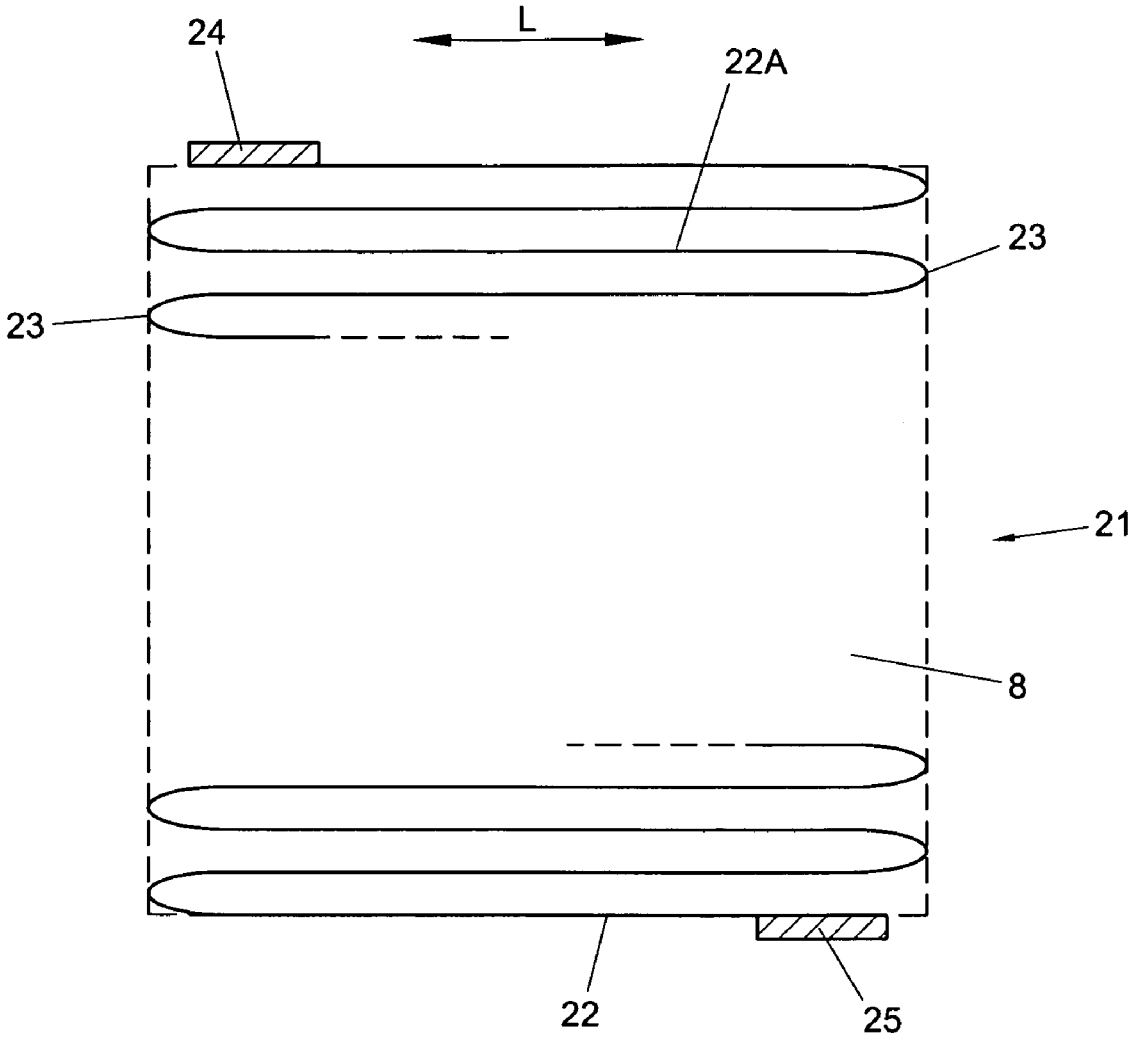
FIG. 7 shows a cassette in side elevation.
Figure 8:
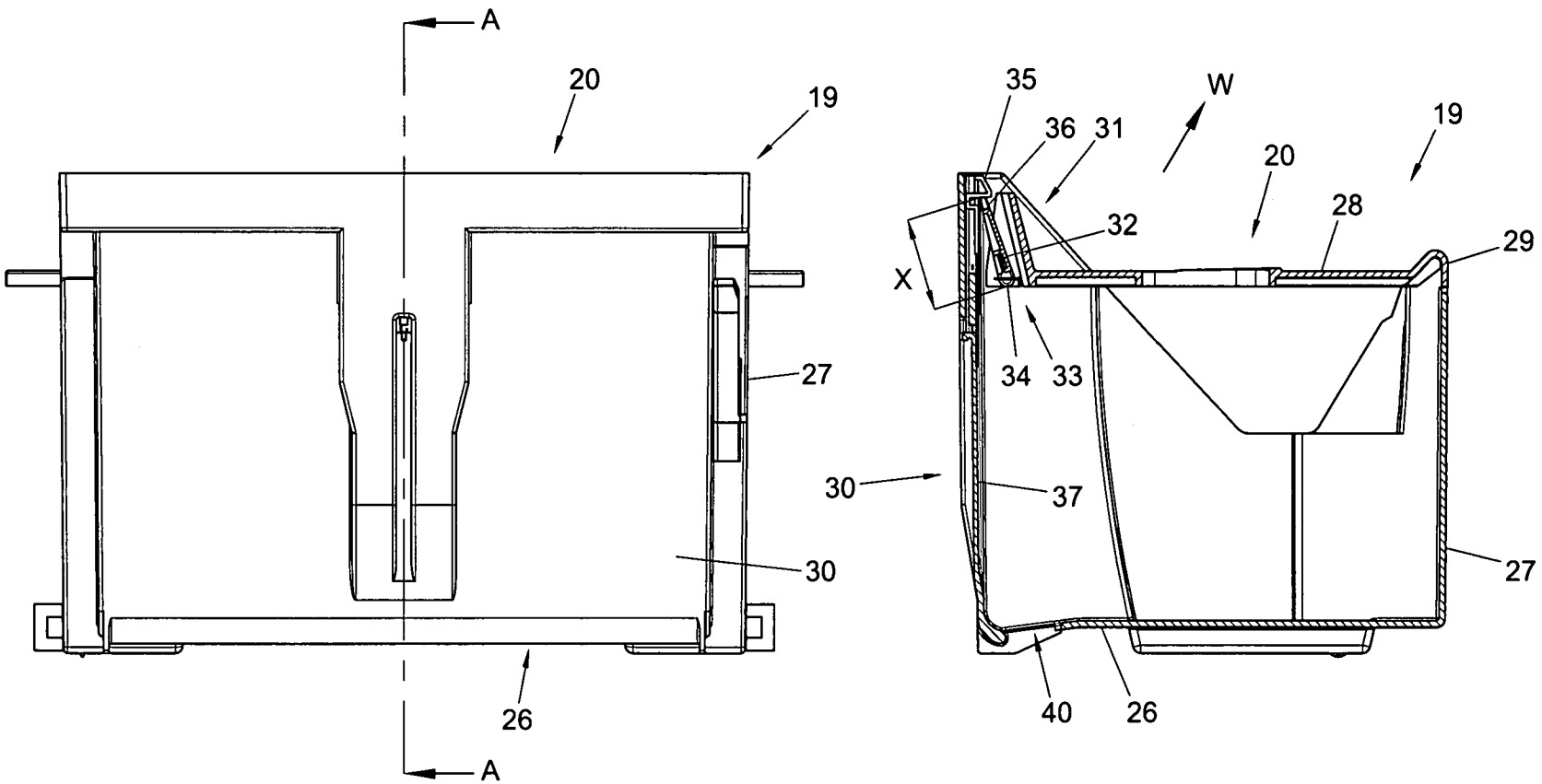
Figure 9:
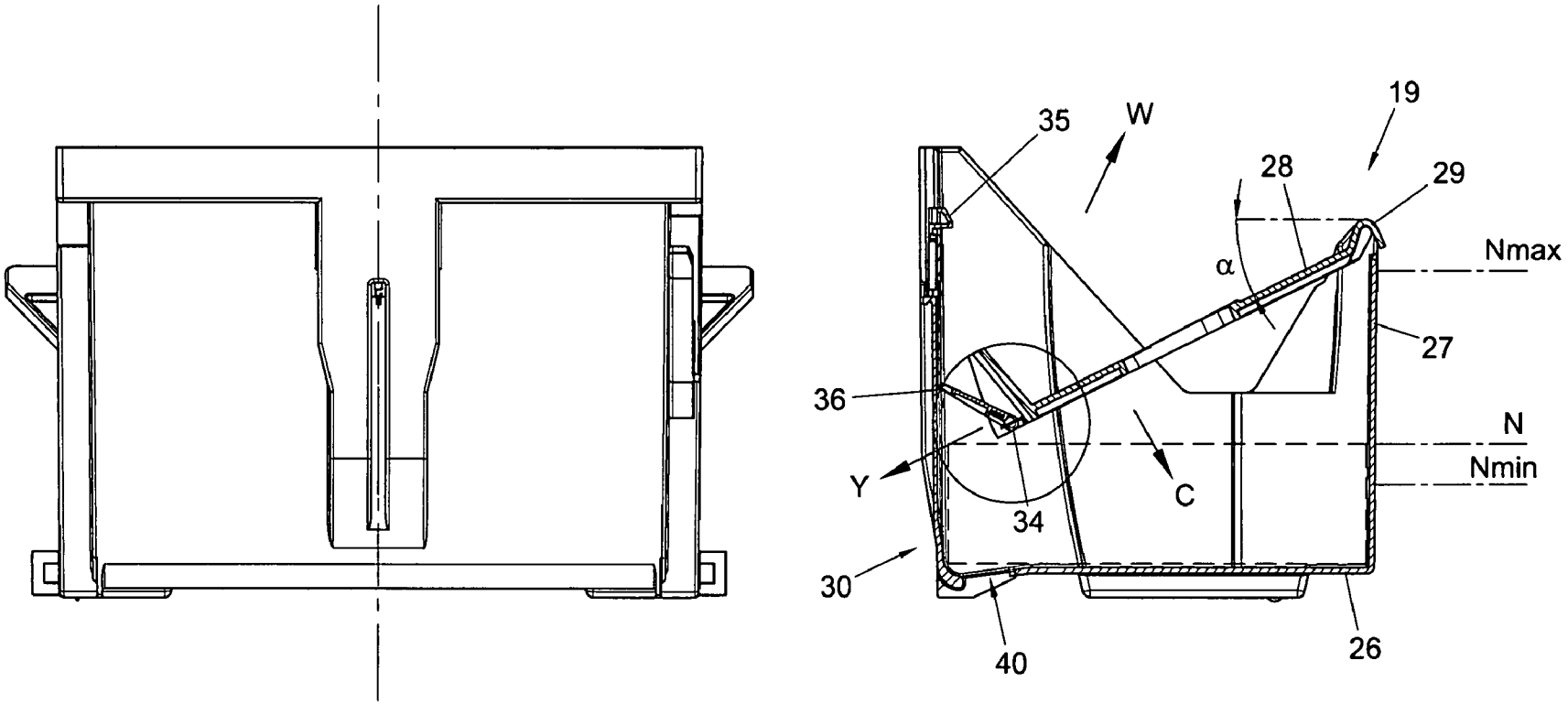
FIG. 9 shows a partly filled cassette holder, in front and partly sectional side elevation, with the contours of a cassette drawn in, suitable for replenishment.

In FIG. 7 a cassette 21 of towel material 8 is shown, schematically and in side elevation, while in FIGS. 8 and 9 a cassette holder 19 is shown, in front and partly sectional side elevation.

The cassette 21 of towel material 8 in this embodiment comprises a long, zigzag folded strip 22 of towel material 8, for instance having a total length of a few tens of meters up to more than a hundred meters and having a width of for instance between 10 and 30 cm, for instance approximately 230 mm, the strip 22 being folded zigzag by folding lines 23 extending at right angles to the longitudinal direction L. Between successive folding lines 23, in each case a sheet 22A is formed having for instance a length between 10 and 20 cm, for instance 17 cm. Naturally, these dimensions can be chosen depending on for instance the towel dispenser and the specified values should be taken as mere examples and not as limiting in any way. The towel material can for instance comprise a woven and/or nonwoven, moisture absorbing material such as paper or fabric such as cotton, possibly provided on a core such as a netting. At the top side of the cassette 21, preferably a first coupling means 24 is provided, for instance an adhesive strip or a first part of a Velcro connection, while at the bottom side of the cassette a corresponding second coupling means 25 may be provided, for instance an adhesive strip or a second part of a Velcro connection. By placing a cassette 21 by the bottom side thereof onto the top side of another cassette, such that the first and second coupling means 24, 25 are coupled, cassettes 21 and hence strips 22 of towel material 8 can be interconnected, so that in effect an endless strip of towel material can be formed. As will be further discussed hereinafter, this can be made use of when replenishing the towel dispenser.

FIGS. 8 and 9 show a cassette holder 19, in wholly filled (FIG. 8) and partly filled or empty (FIG. 9) condition, respectively. In FIGS. 8 and 9 the cassette holder is shown in the position as represented in FIGS. 3 and 4, with the filling opening 20 up. The cassette holder 19 has a bottom 26 and a circumferential wall 27, while a cover 28 is pivotably connected, via a pivot 29, with the wall 27 on a first side, being the rear side in the embodiment shown. On the second side 30, situated opposite the pivot 29, the cover is provided with a locking means 31, which prevents opening of the cover 28 in the filled condition shown in FIG. 9, or at any rate makes this more difficult. In the exemplary embodiment shown, the locking means 31 comprises a pivoting arm 32 which is connected by a first end 33, via a pivot 34, with the cover. The wall 27 is provided, on the second side 30, near the top, with a cam 35 reaching into or above the filling opening 20, under which cam 35 the second end 36 of the pivoting arm 32 can engage, so that an upward pivoting of the cover 28, in the direction W, is prevented. In the second side 30 of the circumferential wall 27, under the cam 35, a slot 37 may be provided having a width at least equal to and preferably greater than the width of the second end 36 of the pivoting arm 32.

Figure 5:
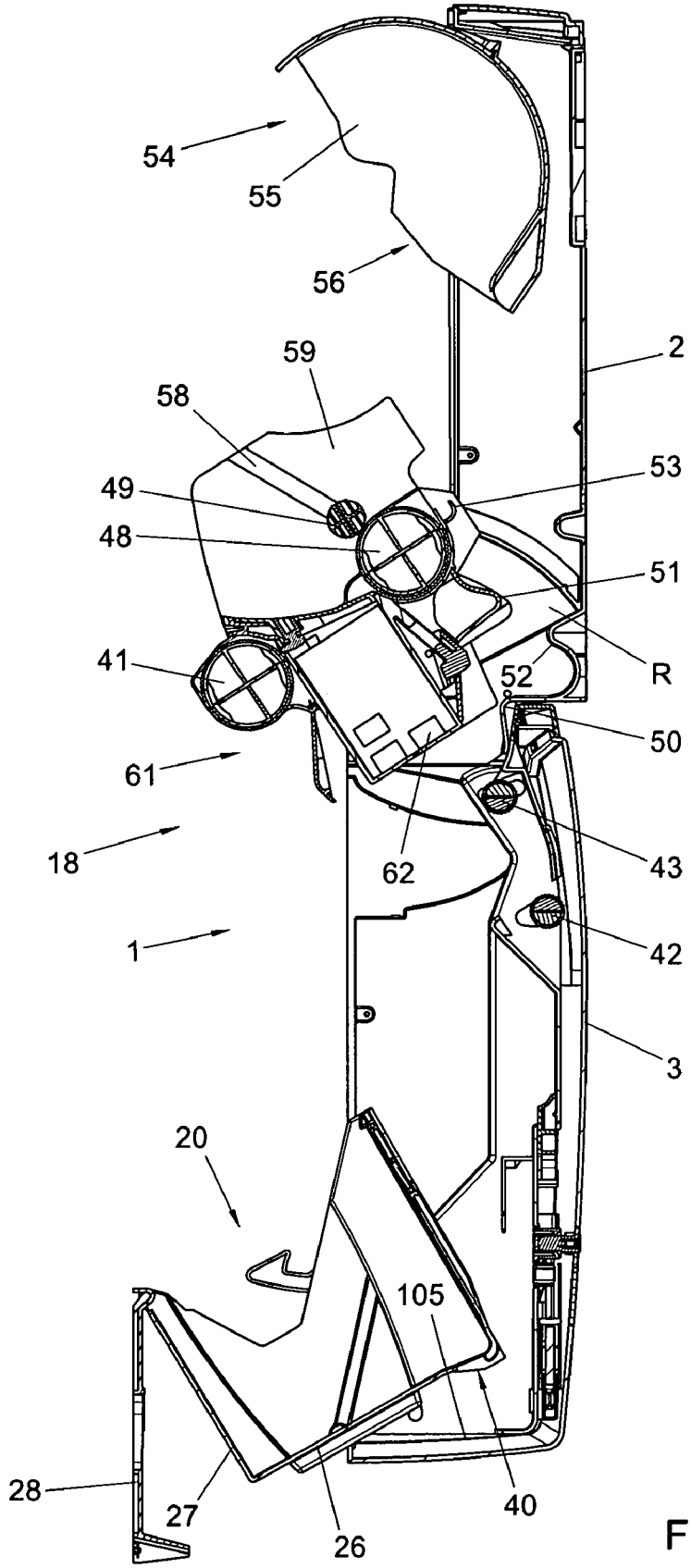
FIG. 5 shows in partly sectional side elevation a towel dispenser in open condition, for first time filling and feeding through a strip of towel material.
Figure 6:
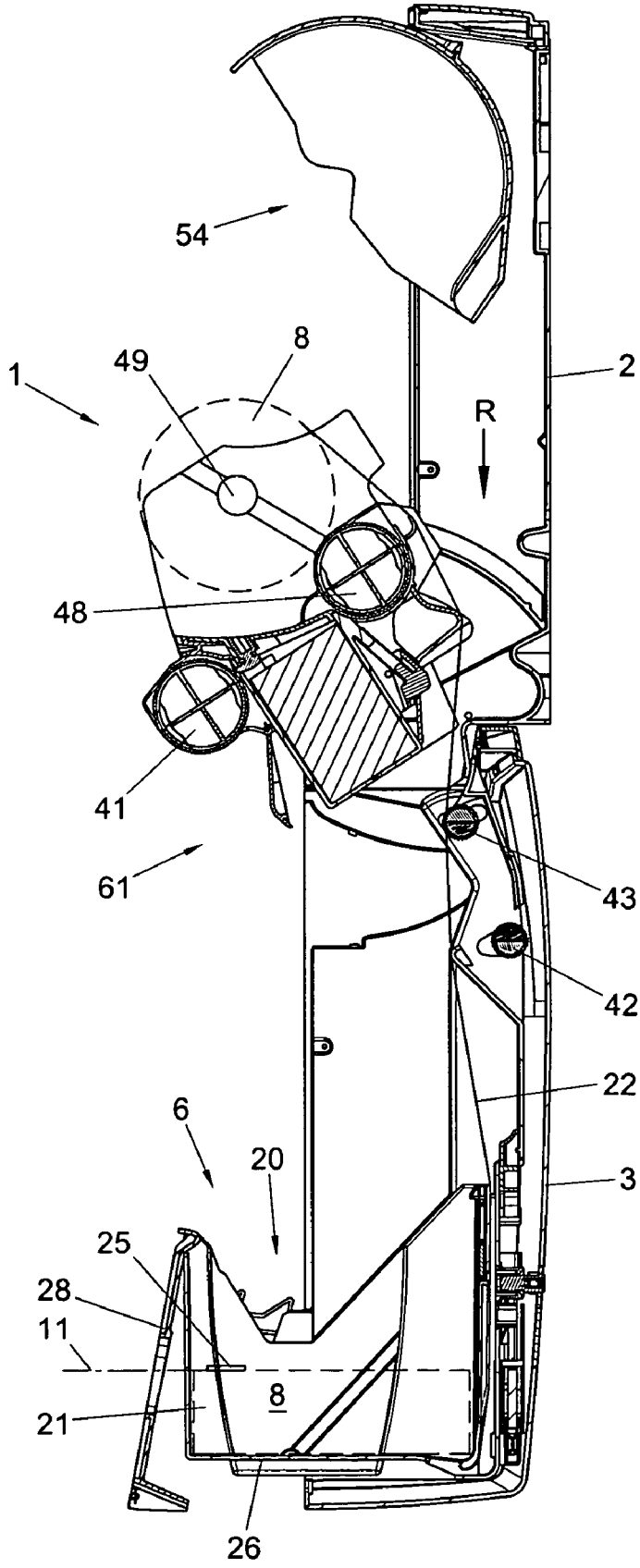
FIG. 6 shows in partly sectional side elevation a towel dispenser in open condition, during feed-through of towel material.

The length X of the pivoting arm 32 has been chosen such that if the cover 28 has pivoted down from a position as shown in FIG. 8 through a chosen angle $\alpha$, the pivoting arm 32 can pivot down from a position reaching up from the pivot 34 as shown in FIG. 8, beyond a locking position, for instance beyond a horizontal position. This position can for instance be determined in that the second end 36 can enter the slot 37, thereby affording room for the pivoting movement mentioned. Then, the cover 28 can be pivoted upwards, through the filling opening 20, thereby clearing the filling opening 20, as shown in FIGS. 5 and 6, so that a cassette 21 can be placed. The pivoting arm 32, upon opening of the cover 28, will reach down from the pivot 34 and thereby "follow" the cover, which means that the second end 36, in the direction of movement, will trail behind the cover and hence can pass the cam 35. Preferably, spring means 38 are provided which bias the pivoting arm 32 in the direction Y, approximately in line with the cover 28.

When a cassette 21 has been placed in the cassette holder 19, the cover 28 can be closed. The pivoting arm 32 will thereby run against the top side of the second part 30 of the circumferential wall 27 and be pivoted upwards, and proceed to trail in the direction of movement C. If the cassette 21 or at least the filling of the cassette holder 19 is between chosen limits, that is, if the top of the cassette or of the upper cassette 21 is between minimum level $N_{min}$ and maximum level $N_{max}$, then the cover 28 can be moved against the top of the cassette or upper cassette 21, such that the second end 36 of the pivoting arm 32 is pressed under the cam 35, whereby it is preferably pressed against the wall 27 through the bias by the spring means. The cover 28 then cannot pivot back up again. If the upper level N of the filling of the cassette holder 19 is below a minimum level $N_{min}$, then the pivoting arm 32 will continue to pivot and not engage under the cam 35, so that the cover 28 can open again. If the upper level N of the filling of the cassette holder 19 is above a maximum level $N_{max}$, then the pivoting arm 32 will not be able to engage under the cam 35, so that it is impossible for the cover 28 to be closed and/or to open again. Naturally, the cassette 21 may deform to some extent upon closing of the cover, so that some tolerance in respect of level N can be obtained, but overfilling can be simply prevented in this way, while moreover it is immediately clear when insufficient towel material 8 is available or at least when the cassette holder 19 can be replenished.

The cam 35 is preferably set up so as to spring to some extent, such that some flexibility is obtained in filling. In particular, the arm 32 can be pressed under the cam 35, for instance by compressing the towel material, while the cam 35 is biased by a spring in the direction of the bottom side of the cassette holder 19. Upon release of the cover 28, the cam 35 will be pressed upwards by the arm 32, against the spring action, so that the towel material can assume its original shape again and so will not be clamped in the holder 19 anymore.

The cassette holder 19 and/or the cassette 21 may be provided with indication means, from which it can be read, possibly without the towel dispenser 1 or at least the cassette holder 19 needing to be opened, what the degree of filling is. Thus, use can be made of color coding as known from EP 05075253.4, for instance by a sticker or printing on the inside of the holder 19 to indicate how much towel material 8 can be added, while cassettes 21 can be used with different amounts of towel material 8, which are provided with different color codings, while the position of the cover 28 and/or the pivoting arm 32 or other indicator can indicate which color and hence which cassette 21 can be added in the cassette holder 19. Possibly, a rod system or other mechanism may be provided which operates a color indicator in the cover, such that it can be read by the color of the color indicator how much towel material is still present in the cassette holder 19 and it can be estimated if, and if so, how much towel material can or must be supplemented.

In the bottom 26, in the example shown near the second part 30 of the circumferential wall 27 under the cam 35, a slot 40 may be provided through which the strip 22 of towel material 8 can be passed, as represented in FIG. 2.

The drive and/or brake means 13, as shown in FIG. 2, can comprise a guide roller 41, a first pressure roller 42 and a second pressure roller 43, rotatable on axes 44, 45, 46 which preferably extend substantially parallel to each other. In an electrically driven embodiment, for instance a fully automatic dispenser, the first and second pressure roller 43, 43 are preferably mounted on a shared pivoting head, such that when one of the pressure rollers 42, 43 is moved in the direction of the guide roller 41 by pulling the towel material in the direction F, the other one of the two pressure rollers 43, 42 is moved away therefrom. For dispensing towel material, for instance the guide roller 41 is driven, for instance electrically or by pulling the towel material in case of a manually or semiautomatically operated version. The guide roller 41 and the pressure rollers 42, 43 preferably have a slightly rough or otherwise friction-enhancing surface, for instance of plastic or rubber. Above the guide roller 41, in the cover 3 a guide edge 47 is provided which guides the strip 22. In this embodiment, the strip is guided down from the cassette holder 21, over the guide edge 47, such that it passes a vertical plane Z through the axis 44 of the guide roller 41 and is then guided back over the front side of the guide roller 41. The strip 22 then extends between the outer surfaces of the guide roller 41 and the first and second pressure roller 42, 43. The strip 22 can be clamped either between the outer surfaces of the first pressure roller 42 and the guide roller 41, or between the outer surfaces of the second pressure roller 43 and the guide roller 41 or over the outer surface of the guide roller 41, clear of the first and second pressure roller 42, 43.

In the electrically driven variants, the roller 42 may be arranged immovably, as a brake roller. In a hand-driven variant, the roller 42 could possibly be left out.

Near the rear side 104 of the towel dispenser 1, the collecting means 7 are provided with a second guide roller 48, as well as a wind-up roller 49. The wind-up roller 49 can rotate freely and can abut by an outer surface thereof against the outer surface of the second guide roller 48. The strip 22 of towel material 8 has been formed into a loop 10 and has been guided at the rear side along a first guide edge 50 of the back part 2 and along a second guide edge 51 which is situated slightly higher and more towards the rear side 104 with respect to the first guide edge 50. Then, the strip has been guided along a third guide edge 52 of the back part 2 and a fourth guide edge 53. The strip 22 has been fixed to the wind-up roller 49, for instance through clamping, sticking, adhesion or in another suitable manner, such that upon rotation of the wind-up roller the strip 22 is wound around it. A cap 54 is provided which reaches over the wind-up roller 49 and rests by two side baffles 55 on the shaft 57 thereof. In this way, the wind-up roller 49 is pressed in the direction of the second guide roller 48, so that at all times a good contact is preserved between the wind-up roller 49 or used towel material 8 wound thereon and the second guide roller 48. With an increasing amount of towel material 8 on the wind-up roller 49 and hence with an increasing diameter of the assembly of towel material 9 and wind-up roller 49, the wind-up roller 49 will be pressed away further from the second guide roller 48. As shown in FIGS. 5 and 6, the shaft 57 of the wind-up roller 49 has both ends placed in guides 58 in guide baffles 59, which guides 58 incline slightly with respect a vertical line. The side baffles 55 have a free longitudinal edge 56 which rests against the shaft 57 of the wind-up roller 49 and form a curve which is such that the force exerted by the cap 54 on the shaft 57 in the direction of the driving roller is approximately equal at all times. As a result, a proper winding up of the towel material 8 is ensured.

The first and second guide roller 41, 48, together with the second and fourth guide edge 51, 53 and the wind-up roller 49 with guide baffles 59, can be provided on a guide unit 61, which can be tilted from a position of use as shown in FIGS. 2 and 4 to a position as shown in FIGS. 5 and 6, whereby the guide unit is tilted slightly forward and the space R between a rearwardly facing side thereof and the back part 2 is enlarged. In particular, the second and fourth guide edges 51, 53 are moved forwards and possibly slightly up, so that passing a strip 22 of towel material 8 behind the guide unit 61 is simplified. The cap 54 is then pivoted upwards, so that the wind-up roller 48 can be simply accessed, for instance for replacement, removal of used towel material, fastening of an end of the strip 22, maintenance and the like. Because the cover 3 is pivoted down, moreover, the pressure rollers 42, 43 are moved away from the first guide roller 41, so that the strip 22 can be simply guided along the pressure rollers 42, 43.

This position can for instance be set when a first time towel material is to be guided from the cassette to the roller 48, passing behind the unit 61.

If in an empty cassette holder 19 a cassette 21 is laid, then in the position shown in FIGS. 5 and 6 a strip 22 can be introduced into the towel dispenser 1.

Directly above the guide roller 41 a small groove may be provided having a narrow width viewed in the longitudinal direction of the strip. A small knife that may be used for cutting off the roll may be guided by the groove, so that no danger exists of the dispenser being damaged or a user cutting himself. Along the groove, small teeth may be provided onto which the towel material is pressed during cutting, for temporarily securing it from displacement, in particular in a direction parallel to the groove.

The cassette holder 19 is tilted forward, as shown, so that the slot 40 comes to lie at a relatively large distance from the adjacent surface 105 of the cover, which in a position of use forms a part of the top side 102 of the housing 100. The cover 28 of the cassette holder 19 is opened and a cassette 21 is laid in, whereby an end E of the strip 22 is passed through the slot 40 and is passed behind the circumferential wall 27, in particular along the first part thereof, back up. The cassette can then be laid in the cassette holder 19 and the cover 28 can be closed over it. In the manner described earlier, the pivoting arm 32 is thereby secured under the cam 35, so that the cover 28 is kept closed. The cassette holder 19 is pivoted back into the initial position as shown in FIGS. 4 and 6. Said end of the strip 22 is pulled up further, in front of the pressure rollers 42, 43 and as described behind the pressure unit 61, of which said end E is fastened on the wind-up roller 48. Optionally, the wind-up roller 48 may be rotated one or more times about its shaft, so that the strip is properly connected therewith. The pressure unit 61 can be pivoted back up and rearwardly, to the position of use as shown in FIGS. 2 and 4, so that the strip 22 is deformed and is guided over the four guide edges 50, 51, 52, 53. The cap 54 is moreover laid over the wind-up roller. With this, the towel dispenser 1 is ready to be closed.

Upon closure of the cover 3 over the back part 2, the cassette holder 19 with the cassette 21 is tilted upside down, so that in use the strip 22 of towel material 8 is pulled away from what is then the upper side of the cassette 21. The cassette 21 rests on the cover 28 which can be kept closed therewith. The cover is moreover preferably biased into the closed position, for instance by a draw spring and can be opened so far that the same spring keeps it at least temporarily in the opened position. In addition, in the back part, cams or like protrusions may be provided, on which the cover can rest if the apparatus is closed, for a still better securement against undesired opening of the cassette holder. By the closure of the cover 3, further, the pressure rollers 42, 43 are moved near and/or against the towel material 8 of the strip 22 near the first guide roller 41, and the guide edge 47 is moved against the strip 22. Further, this pivoting movement of the cover 3 provides for the formation of the loop 10. A lock 63 may be provided, with which the cover 3 is retained on the back part 2.

The guide rollers 41, 48 can possibly be driven by manual force. If said force F is exerted on the front part of the loop 10, the first guide roller 41 can then be rotated. Preferably, the second guide roller 48 is coupled to the first guide roller 41, for instance electrically or mechanically, so that the second guide roller rotates over an equal angle and provides for the rolling up of an amount of used towel material 8 corresponding to the amount of dispensed clean towel material. As a result, a loop of equal length is preserved at all times.

The first and/or second guide rollers 41, 48 may also be driven differently, for instance electrically and/or mechanically, for instance controlled by an earlier-mentioned sensor and a processor 62 with which the amount of towel material 8 can be accurately determined, for instance half the loop length each time. Also, the amount to be dispensed may be settable, for instance depending on the material 8 and/or the preferences of a user, fitter, manager or the like.

Figure 6A:
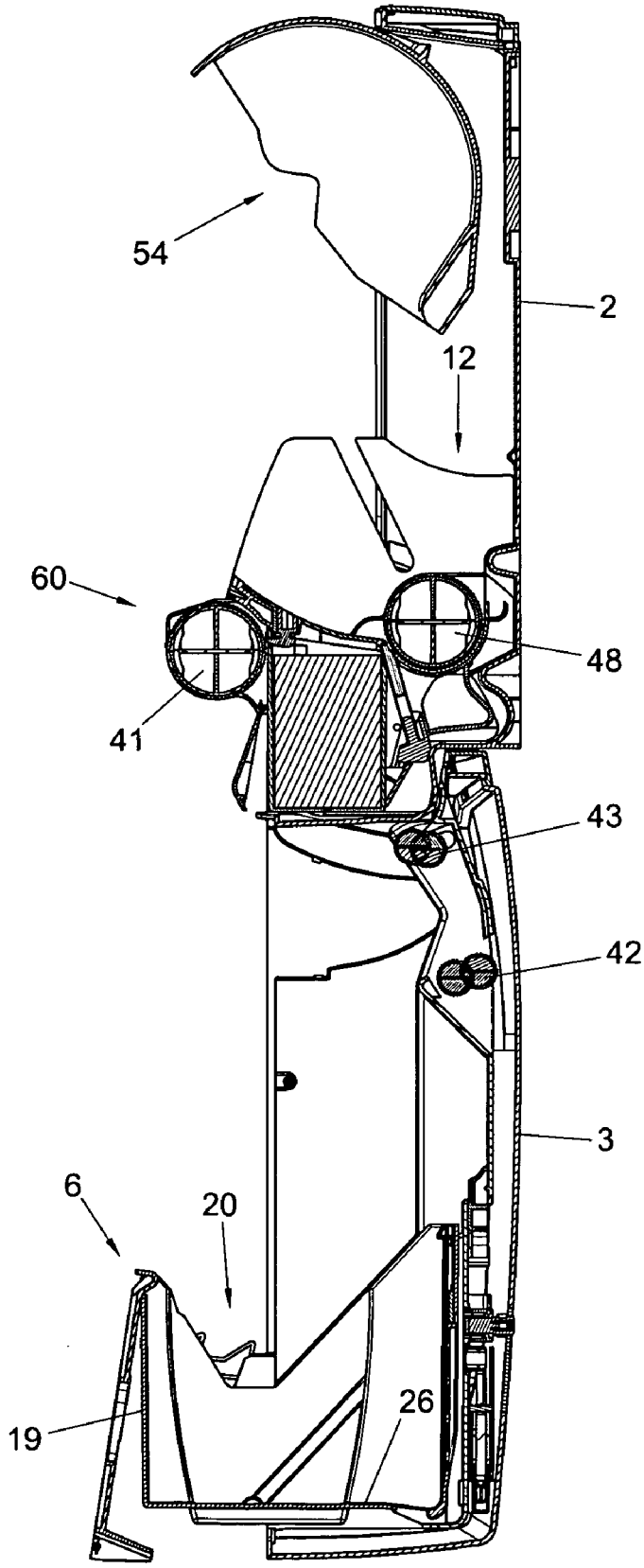
FIG. 6A shows in partly sectional side elevation a towel dispenser in opened condition during replenishment.

In FIG. 6A a towel dispenser 1 is shown during replenishment of towel material 8 in the cassette holder 19. To that end, again the towel dispenser is opened and the cover 3 pivoted down. The residual amount of towel material 8 in the cassette holder falls onto the bottom 26 and the cover 28 of the cassette holder 19 is opened, assuming that the level N has fallen below the minimum level. If not, replenishment is not necessary and replenishment is possibly prevented by the flap which will be unable to open. If so much towel material has been removed that the flap can be opened, towel material can be added. If too much towel material is added, the cover will not be able to close. This can be restored by adding a different amount of towel material. Too much towel material can render feed-through of material difficult and lead to undesirably high forces and stresses, so that tearing may occur. This can thus be prevented. Moreover, the resilient cam 35 will afford room. A new cassette 21 is laid, with the first coupling means 24 down, from above into the cassette holder, such that the first coupling means 24 is coupled with the residual strip 22 and in particular with the second coupling means 25 provided thereon. As a result, a firm connection is obtained between the residual part of the partly used-up cassette 21 in the cassette holder and the new cassette 21. Next, the cover 28 can be closed again. The wind-up roller 49 can be taken out. The strip 22 can be cut through above the pressure unit 61, after which the used towel material 8 can be removed from the wind-up roller 48. The cut-loose end of the residual strip 22 can then be attached to the wind-up roller 49, in one of the earlier-described manners, after which the wind-up roller 49 can be re-placed, the cap 54 can be pivoted back and the towel dispenser 1 can be closed. It is then ready for use again.

Directly above the guide roller 41 a small groove may be provided having a narrow width viewed in the longitudinal direction of the strip. A small knife that may be used for cutting off the roll may be guided through the groove, so that no danger exists of the dispenser being damaged or a user cutting himself. Along the groove, small teeth may be provided onto which the towel material is pressed during cutting, for temporarily securing it from displacement, in particular in a direction parallel to the groove.

Because upon opening of the towel dispenser 1 the cassette holder 19 is brought down, it can be simply filled. Moreover, feed-through of the strip 22 is particularly simple.

The first and second pressure roller 42, 43 can have different functions. The second pressure roller 43 can guide the strip 22 along the first guide roller 41, so that a relatively great length of the strip 22 extends along the outer surface of the guide roller 41. The second pressure roller 43 can then be preferably rotatable about its axis 46. The first pressure roller 42, in the electrically driven design, preferably cannot rotate about the respective axis 45, or can, but only in a strongly braked manner. The pressure rollers 42, 43, with respect to the guide roller 41, are preferably biased in the position shown in FIG. 2, for instance by a spring which presses the second pressure roller 43 against the guide roller 41 or against a strip 22 pulled over it. With this, the first pressure roller 42 is kept away from the strip. If, however, a force F is exerted on the first part of the loop 10, downwardly, then the second pressure roller 43 will be pulled away from the guide roller 41, thereby automatically pressing the first pressure roller against the strip 22. The strip 22 will thus be clamped between the stationary or strongly braked first pressure roller 42 and the guide roller 41, so that further pulling down of the strip 22 is prevented. Accordingly, the first pressure roller then has a blocking function.

In a mechanical variant of the towel dispenser, for instance the guide roller 41 may be mounted on a blocking ring which for instance allows one, or any other pre-selected number of revolutions of the guide roller, for dispensing a pre-selected amount of towel material. In an electrically driven variant as shown, the blocking function of the first pressure roller 42 as described above, however, has the advantage that manual dispensing of towel material is prevented. If towel material is to be dispensed, the first guide roller can be driven by a motor 63 for a desired time, in FIG. 2 in counterclockwise direction, so that a pre-selected length of towel material is dispensed.

Preferably, a control unit 60 is provided, comprising for instance a motor 63 with transmission 64, a battery 65 and a control unit 60 with processor 62, for instance a computer, allowing electronic control of, for instance, material dispensing. For instance the transmission may then be configured such that the two guide rollers can be driven separately. The guide rollers or other parts in the drive or transmission may be provided with a freewheel, such that if the motor rotates in a first direction, the first guide roller rotates and the second guide roller does not, whereas when the motor rotates in an opposite second direction the first guide roller stands still and the second one rotates. A clutch may be provided for at least one of the rollers 41, 48, so that they may also be driven simultaneously, in the same and/or opposite directions.

The control unit 60 may be set such that the towel dispenser 1 registers when a user has dried his hands on the loop 10 or the loop 10 has been used otherwise, for instance by a proximity switch or through detection of a force F exerted on the second pressure roller 42, at least movement thereof. In the embodiment shown, a small flap 120 is provided which projects downwards and forwards from a pivot. The towel material has been guided over this, so that a bend is provided therein. The flap carries a small magnet next to which a sensor 121 such as a Hall sensor is provided. If the towel is pulled in the direction F or if it is moved otherwise, then the flap 120 will pivot to some extent, without towel material being given out from the cassette. The magnet moves relative to the sensor 121, so that a change in the magnetic field is observed. This can start the giving out of towel material while the loop length does not change. After some time, for which purpose a time delay may be set, the control unit 60 can proceed to control the motor 63 in order to replace at least a part of the loop 10. To that end, the guide rollers 41, 48 can be driven, in FIG. 2 in opposite direction, so that for instance towel material 8 is taken in by half a length or the entire length of the loop 10 by the wind-up roller 48 and at the same time a same length is dispensed from the cassette 21. Preferably, each time, only a part of the loop 10 is replaced, for instance half of it, so that a dirty front part is moved rearwards and the front part is replaced by clean towel material. It will be clear that a movement of the flap 120 relative to a sensor detection element may also be registered in a different manner, for instance through movement, acceleration, strain gauge or the like.

In order to prevent or at least minimize drift in the loop length K under the towel dispenser, the loop may periodically be taken in entirely and be formed anew. To that end, for instance the second guide roller 48 may be driven while the first guide roller is kept stationary, so that the entire loop is taken in until the towel material lies tautly against the underside 11 of the housing, after which a pre-selected amount of towel material can be dispensed for forming a new loop 10. The length to be dispensed can for instance be determined by the number of strokes of the or each respective guide roller or of, for instance, one of the gearwheels of the drive, since a revolution of a guide roller will correspond to a length of towel material 8 to be dispensed that corresponds to the outer circumference of the respective guide roller 41, 48. In this way, clean material is dispensed at all times. Possibly, material could be dispensed from the intake roller, but this entails the risk of dirty material being presented.

In the same way it is possible after each use to have the towel dispenser take in the whole loop 10 and to form a new loop 10 of new or at least clean towel material 8 when the presence of a user or at least his hands is detected near the bottom of the towel dispenser. This is for instance advantageous if the towel dispenser is used in an environment where hygiene is of particular relevance or regulations are such that towel material after use is not allowed to remain in the environment but must be collected and/or shielded, as in food applications, for instance in the catering industry, food preparation and the like.

Figure 12:
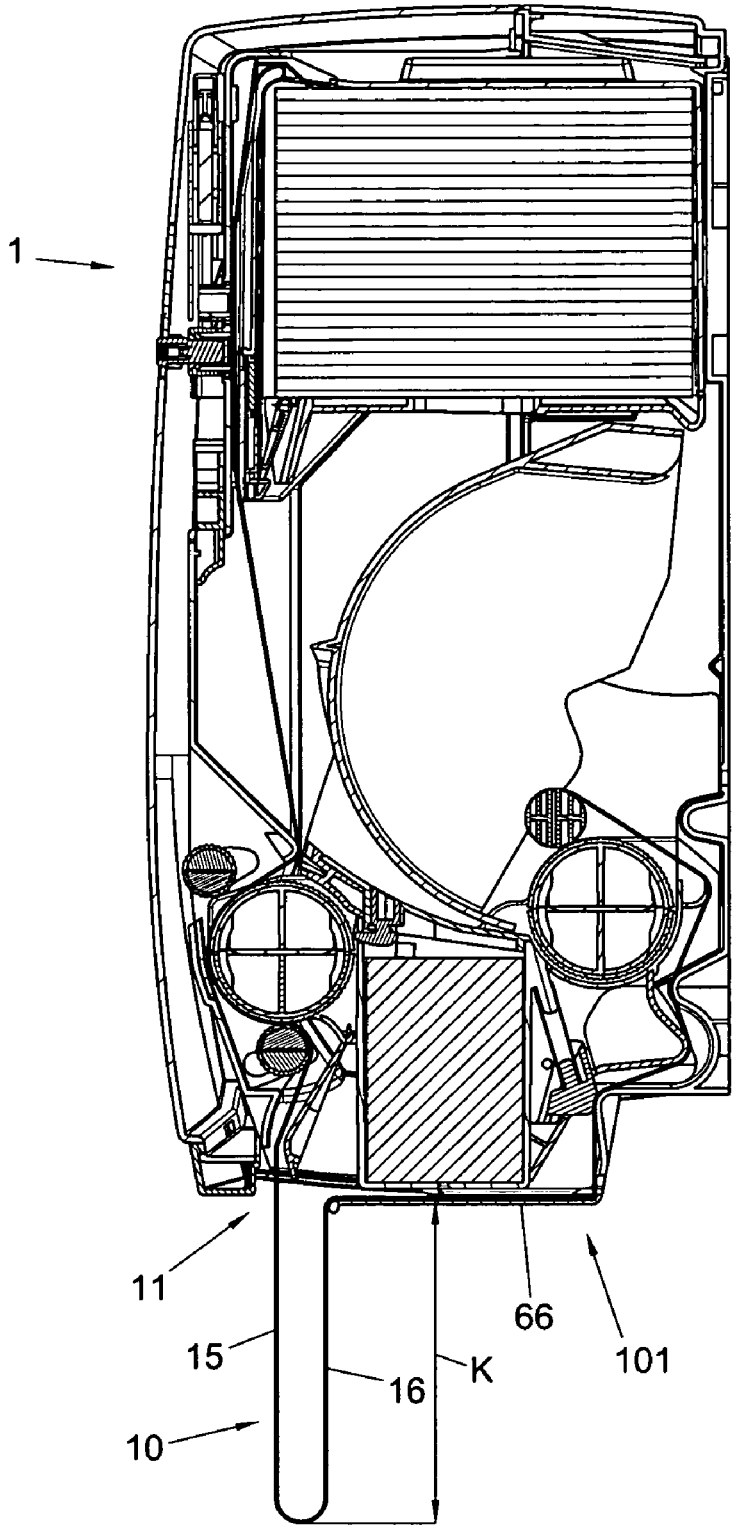
FIG. 12 shows in side elevation a further alternative embodiment of a towel dispenser.

In FIG. 12 an alternative embodiment of a towel dispenser 1 is shown which is particularly suitable for such an application such as food application. The towel dispenser may for instance be designed as described with reference to FIGS. 1-6, while, however, at the bottom side 101 a covering and guide 66 is provided, so that the loop 10 is formed differently. The loop 10 here has a front and a rear part 15, 16 which are relatively close next to each other or even abut mutually, in particular such that they can be jointly used for drying hands. After use of a loop 10, the whole loop 10 can be taken in, after which as described a new loop 10 is formed, preferably wholly from clean towel material 8, when a user approaches the towel dispenser 1 or for instance brings his hands near the bottom side of the towel dispenser 1.

Figure 10:
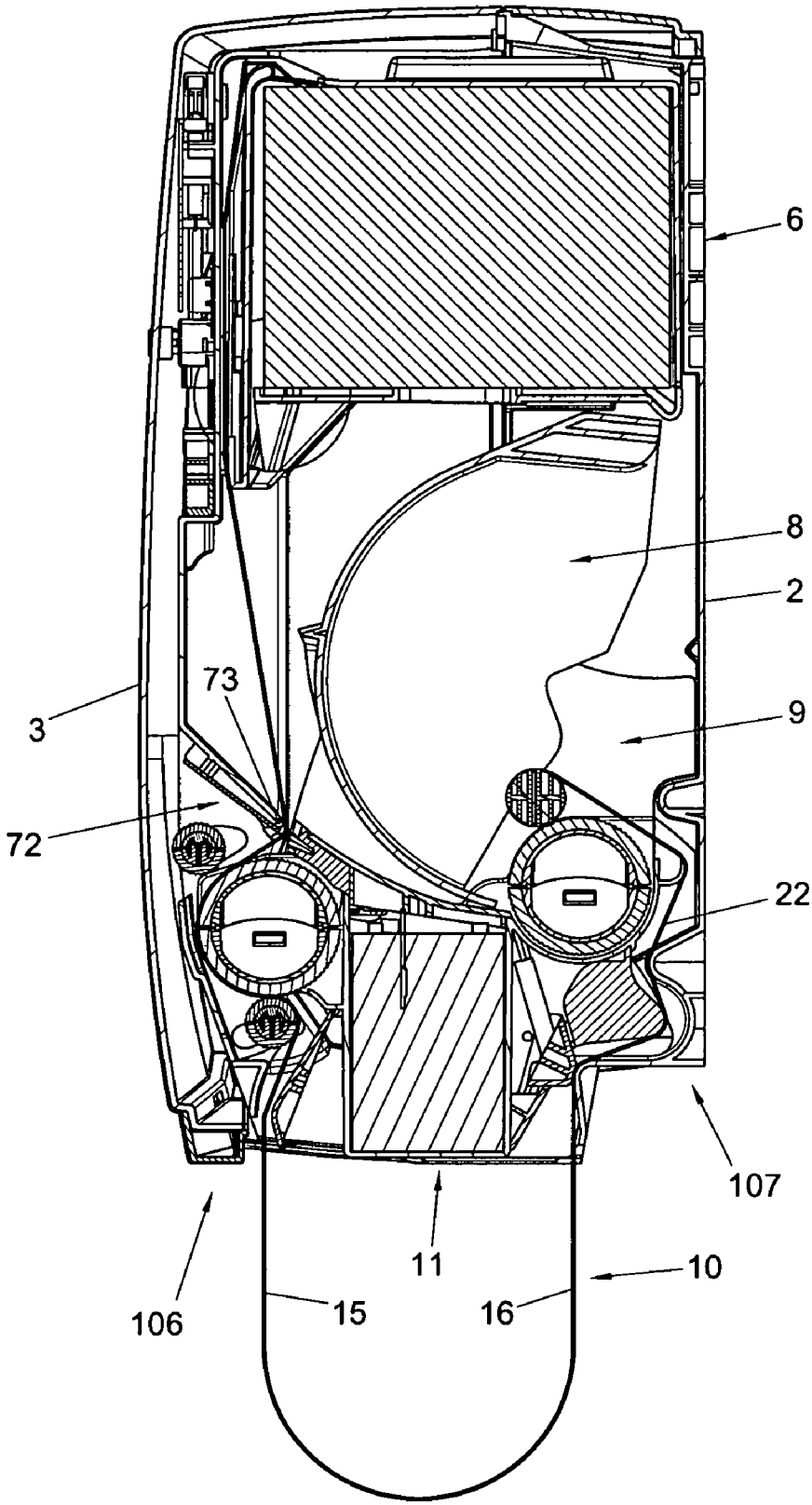
FIG. 10 shows in partly sectional side elevation an alternative embodiment of a towel dispenser, in closed condition.
Figure 11:
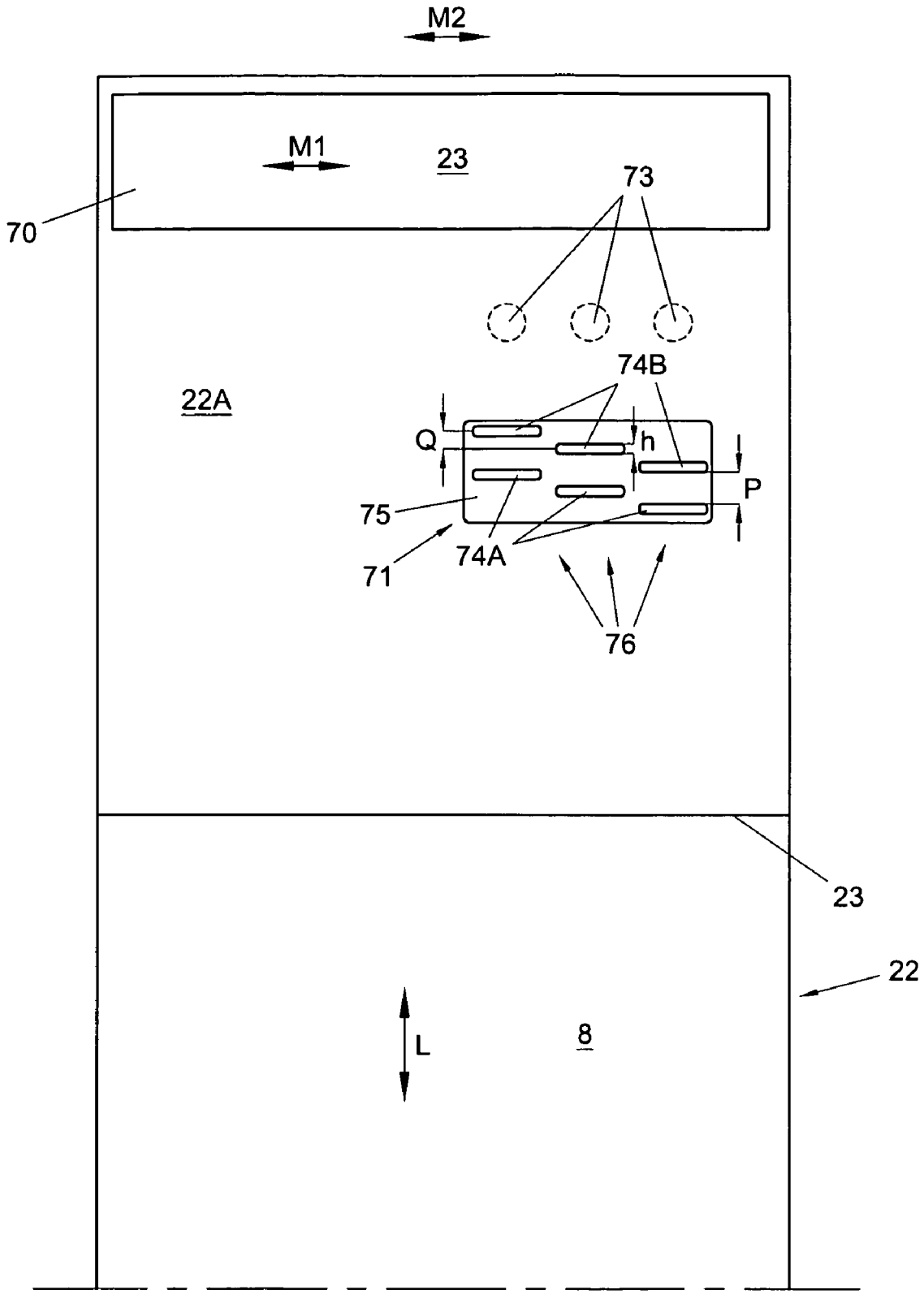
FIG. 11 shows in top plan view a strip of towel material with marking means.

FIG. 11 schematically shows a strip 1 of towel material 8, in particular an upper sheet thereof, at least a portion of a strip 22 on which a coupling means 23, 24 has been provided. In the exemplary embodiment shown, a surface 70 of adhesive such as glue is provided, which surface is for instance rectangular having a longitudinal direction M1 extending in the transverse direction M2 of the strip 22. In an advantageous embodiment, use is made of a surface 70 of an adhesive which can be detachably coupled with a corresponding surface on a further strip as detachable coupling means. For instance use is made of a Velcro connection or contact adhesive or like coupling means. Recouplable coupling means offer the advantage that restoration or rearrangement of a connection is possible in a simple manner. Provided on the strip 22 is a recognition means or marking 71, for instance a pattern of metal surfaces 74. This can for instance be provided on and/or in the strip 22 by printing technique, sputtering, gluing, weaving or any other suitable manner. In an alternative embodiment, the marking is at least partly or wholly provided in the form of a sticker which can be or has been glued onto the strip. In the embodiment shown in FIG. 10 of a towel dispenser 1 which may further be designed wholly or substantially as described earlier, a sensor 72 is provided, with which the presence of the marking 71 can be detected when it moves along the sensor 72. The sensor 72 can for instance comprise a number of coils 73 which are positioned close to the strip and with which, with a relatively high frequency, for instance 200 kHz resonances are generated, with a sample rate of for instance 2,000-4,000 Hz. With this, during passage of towel material and in particular the marking along the sensor 72 a large number of times an electromagnetic field can be generated and/or disturbance thereof be established, on the basis of which information about the towel material or at least the marking can be read by the control unit. The marking may then be so designed that if a surface 74 of the marking 71 is situated next to the sensor 72 or at least a coil 73 thereof, such a resonance cannot be generated. Upon passage of such a surface 74 of the marking, a number of cycles said resonance with the respective coil cannot be generated, so that the sensor 72 can sense the presence of the marking or at least of the surface 74. The coils 73 are preferably provided on a PCB. The or each surface 74 of the marking is preferably manufactured from, or comprises, electroconductive parts in order to prevent or at least strongly attenuate said resonance. To that end, the surfaces may for instance be manufactured from metal strips, metallic foil, paint or ink or the like. Any desired number of surfaces may be provided, for instance 2, 4, 5, 6, 9 or any other number, which may be different for instance depending on the type of material. Also the dimensions may be different, for instance in the form of wire.

More in general, a sensor 72 may be provided which can detect a marking 71 on and/or in the towel material or a connecting part in a contactless manner and without light, and on the basis thereof can send a signal to the control unit 60. This may be one or more signals, which can for instance contain information about the nature and structure of the marking, about the position of the marking with respect to the strip, the position of markings relative to each other, and the like, from which, with the aid of the control unit and any software and/or hardware that may be incorporated therein, the towel dispenser can be controlled, for instance a dispensing and intake pattern, waiting times and the like. Thus, for instance, RITF chips may be used or like active and/or passive elements.

In the exemplary embodiment shown, a pattern of surfaces 74 has been provided on a sheet 75, in particular a sticker sheet. The surfaces 74 are provided in three rows 76, which have a longitudinal direction parallel to the longitudinal direction L of the strip 22, while the surfaces 74 in the rows 76, for instance, do not need to be situated directly next to a surface 74 in one of the other rows 76. In the example shown, three rows 76 are provided, each having two surfaces 74A, 74B, placed behind each other with an intermediate space P in the longitudinal direction L of the strip 22. Viewed in the longitudinal direction L, the middle row is staggered over a distance Q relative to the right-hand row 76, and the left-hand row is staggered over a same distance Q relative to the middle row, so that the first surfaces 74A and the second surfaces 74B of the row 76 in a way present a step form. The first surface 74A of the left-hand row, viewed in the longitudinal direction L, is situated before the second surface 74B in the right-hand row 76. It will be clear that this is only an exemplary embodiment of a marking 71 and that many variations thereon are possible. In the sensor 72, three coils 73 are provided, next to each other (in FIG. 11 drawn in schematically above the strip 22), such that upon movement of the strip 22 in longitudinal direction L along the sensor 72, each of the rows 76 moves along one of the coils 73. As a result, the surfaces 74 in the different rows 76 can be detected by the respective coils 73.

Different types of markings 71 can be used, for instance for different cassettes 21, such that using a control unit 60 connected to the sensor 72 the respective cassette 21 or at least coded properties thereof can be determined and the behavior of the towel dispenser can be set accordingly. Coding for such properties is for instance possible through variations of the number of surfaces 74 in the rows 76, through omission of one or more surfaces 74 in one or more rows 76, by the use of different markings 71 on a strip, while coding may be effected by variation in the mutual distance between the successive markings, viewed in longitudinal direction L, while those mutual distances can be used both regularly and equally, and irregularly and/or with variation, as a coding. Another option is variation in the size of the surfaces 74, in particular the height h of the surfaces 74 viewed in longitudinal direction L, by setting one or more surfaces 74 at an angle different from 90 degrees relative to the longitudinal direction L, and the like. Naturally, a sensor may also be provided with more or fewer coils, in which case the markings 71 can comprise more or fewer rows of surfaces in a corresponding manner. Variations thereon are possible and immediately clear to those skilled in the art.

Using the markings 71, a cassette or at least a strip 22 can be coded, for instance, for the material used, such as paper, fabric such as cotton, mixtures thereof, and the like, for instance for the thickness of the material, the number of layers from which it is built up, suitability for particular applications such as food or non-food, desired dispensing length per act of use by a user, waiting time for a user between an act of use such as drying of hands and the dispensing of a new loop 10, dispensing rate and the like. Possibly, using the marking, for instance a supplier of the strip 22 may be coded as well. If use is made of multiple markings 71 placed behind each other in the longitudinal direction of the strip, it may be periodically or continuously checked whether the correct length of towel material 8 is dispensed, whether the length of the loop 10 under the towel dispenser is still correct, what the degree of filling of the cassette is, at least whether an end or beginning of a strip of a cassette 21 is reached, so that an alert can be delivered, or other dispensing-related parameters. Preferably, in the absence of a marking on a strip, the control unit will set a standard setting, so that for instance after each use by a user, for instance for drying of the hands, the whole loop is replaced with clean towel material and there is no waiting time, so that it is always ensured that sufficient clean towel material is available.

It will be clear that on the basis of the codings and the interpretation thereof by the control unit using a dedicated logarithm or software product, the dispensing behavior of the towel dispenser can be controlled. Preferably, settings may be changed by a user, manager and/or manufacturer, for instance through adjustment of the logarithm or software product, through setting of parameters thereof and the like.

In illustration, a marking as shown can for instance have between one and six surfaces 76, substantially manufactured from metal as for instance from aluminum, with the distance Q being approximately 5 mm and the center-to-center distance between the rows being approximately 25 mm. The surfaces themselves can for instance have a width, perpendicular to the longitudinal direction L, of approximately 20 mm and a height h measured in the longitudinal direction L of approximately 3 mm. The sheet 75 can for instance be of paper, 30 by 74 mm in size. The distance between for instance a right-hand longitudinal edge of the strip 22 and the right-hand side of the sheet 75 can then be for instance 20 mm. The materials and dimensions mentioned should naturally be taken merely by way of illustration and should not be construed as limiting in any way.

Thus, the surfaces may be staggered stepwise, in a constant pattern or a chaotic pattern, while the extent of stagger can be adjusted per surface or per whole column. Also, the surfaces may be provided in staggered paths and/or extend over several paths.

In the exemplary embodiment shown, the sensor 72 is placed such that the coils 73 are situated in or near the guide edge 47, such that these coils 73 are always at a small distance from the strip 22 passed over the guide edge 47. The strip being diverted over the guide edge, it will always be moved tautly along it, so that errors in the detection of the marking can be minimized and preferably be virtually precluded.

Naturally, other sensors and associated markings can be used. Moreover, a sensor may also be arranged at other positions and several sensors may be used, for instance one on a dispensing side 106 and one on the intake side 107 of the towel dispenser, so that at all times dispensing and intake of towel material can be detected and checked.

Naturally, in the invention detachable types of coupling means for strips 22 can be used, such as Velcro.

Figure 13A:
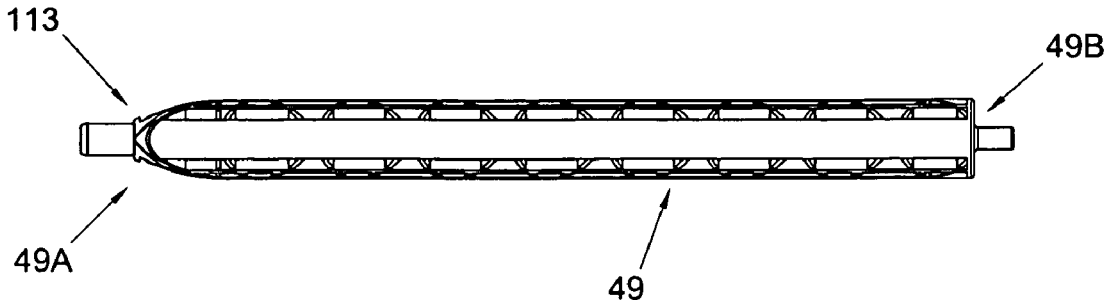
FIGS. 13A and B show in side elevation and sectional side elevation along the line B-B in FIG. 13A a winding roller for taking in used towel material.
Figure 13B:
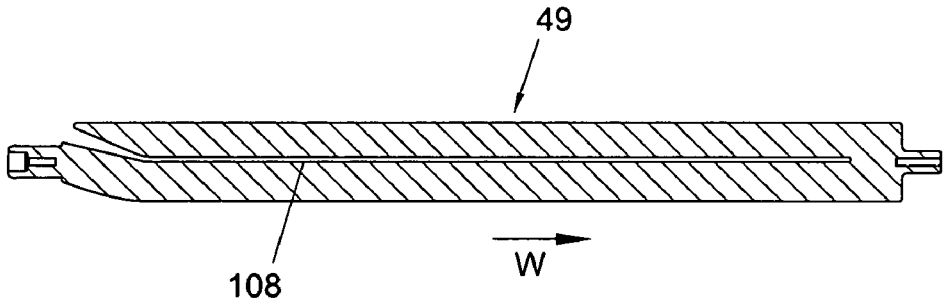

FIGS. 13A and B show a wind-up roller 49 in an advantageous embodiment. It has in a general sense a shape that resembles a hairpin. The roller 49 is for instance manufactured from plastic and has integrated shaft ends 49A, 49B which can be received directly, or with interposition of bearings, in the slots 58. The wind-up roller has a slot 108 which is open adjacent a first shaft end 49A and extends to near the opposite second shaft end 49B. The slot 108 extends over the entire thickness of the roller 49. An end of a strip of towel material can be slipped into the slot 108, for instance laterally, that is, in the direction W in FIG. 14, parallel to the longitudinal direction of the roller 49. Possibly, the slot 108 may be designed such that the roller 49 will thereby clamp the towel material of the strip to some extent. If the roller 49 is then rotated about the longitudinal axis, towel material is wound onto the roller 49 in the earlier-described manner.

Preferably, the end 113 of the roller 49 is slightly tapered on the side where the slot 108 is open, such that the surface of a cross section at right angles to the longitudinal direction decreases from a point near said open end in the direction of the respective shaft end 49A, preferably decreases smoothly. If so much towel material has been wound onto the roller 49 that this can or must be removed, the strip can be cut in the earlier-described manner, after which it can be moved away over said shaft end 49A. The slot 108 being open, the towel material can be simply slipped off the roller 49, so that the roller can be reused. If the respective end tapers slightly, the towel material will not be clamped and can be simply slipped off. Incidentally, the slot 108 can naturally be formed differently, for instance by a clip fitted over the roller 49.

In a variant not shown, instead of the stack of towel material, a roll is provided from which towel material is dispensed. Then in each case a roll will be placed in replacement of a roll already used up wholly or partly. This roll may be provided with a marking as described hereinabove at length. Different combinations between towel material and markings are possible. Also, this towel material, like the folded stacked material, can be used in various other dispensers and/or dispensing machines.

In an electrical variant of a towel dispenser according to the invention, for instance connectible to a power network or provided with a battery or other energy source, a waiting time can be controlled electronically, for instance using an electromagnet. Such an electromagnet, if switched on, can for instance block the dispensing mechanism, for instance by restraining the roller 41 from rotation, and, if switched off, release this roller. The switched-on time can for instance be controlled by the control unit, for instance depending on markings on the strip of towel material. In a mechanical variant, in a towel dispenser, in a known manner use can be made of a suction cup which holds the roller 41 for some time after material has been dispensed, which determines the waiting time.

In case of a suction cup, it will be possible in each case for a whole revolution or at least a fixed rotation to be traveled before the brake mechanism intervenes again, whereas in the electric variant the magnet can intervene at any time by electric energization thereof. As a result, the dispensing length and/or the waiting time can be simply set, for instance using the control unit 60.

The invention is not limited to the embodiments shown and described in the description and drawings. Thus, combinations of parts of the embodiments shown also fall within the scope of protection of the claims. A towel dispenser according to the invention can comprise other means for taking in towel material, different types of markings may be used, optical or other sensors may be used, and the like. Also, for instance, a stock cassette 19 may be formed or configured in a different manner. Other sensors and markings can be used, as for instance a sensor utilizing radio waves or a coil, the marking being provided with for instance a passive electronic circuit or otherwise radio detectable and preferably readable elements.

The invention claimed is:

1. A strip of towel material for use in a towel dispenser, which strip has a longitudinal direction and a transverse direction and has been folded along folding lines extending in the transverse direction, creating sheets that are spaced apart in the longitudinal direction, such that a stack has been obtained, wherein the strip is provided with a plurality of electronically readable markings that is integrated into or disposed on discrete sheets of the strip at locations that are spatially separated in the longitudinal direction of the strip.

2. A strip of towel material according to claim 1, wherein each of the plurality of electronically readable markings is readable with a sensor in a contactless manner and without light or electromagnetically.

3. A strip of towel material according to claim 1, wherein each of the plurality of electronically readable markings comprises at least one passive electronic circuit, readable with a sensor sensitive to the plurality of electronically readable markings.

4. A strip of towel material according to claim 1, wherein each of the plurality of electronically readable markings includes at least two separate metal surfaces.

5. A strip of towel material according to claim 1, wherein the plurality of electronically readable markings is provided on a sheet that is disposed on or integrated into the strip and wherein said sheet is preferably self-adhesive.

6. A strip of towel material according to claim 1, wherein each of the plurality of electronically readable markings is preferably arranged in a regular pattern integrated into or disposed on the towel material.

7. A set of strips of towel material according to claim 1, wherein at least some of the strips in the set have been folded in a same manner but differ from each other in the plurality of electronically readable markings applied thereto, and wherein any of the plurality of electronically readable markings is distinguished by at least one of their mutual distance, their position, their shape, and their nature.

8. A stack of towel material folded from a strip according to claim 1, wherein the stack has a top side and a bottom side having a first end and a second end of the strip, respectively, wherein at least one of the first end and the second end is provided with a fastening strip connected with the first end by a first connection, on which fastening strip at least one of an adhesive layer and a hook and pile connector has been provided, while on the other of the first end and the second end an adhesive strip may be provided for adhesion with at least one of the adhesive layer and the hook and pile connector disposed on a fastening strip of a second stack.

9. A stack of towel material according to claim 8, wherein the fastening strip is provided with a folding part which is foldable over at least one of the adhesive layer and the hook and pile connector.

10. A stack of towel material according to claim 8, wherein the at least one of the fastening strip and the adhesive strip is fixedly attached to the strip of towel material using a first adhesive means, the adhesive layer includes a second adhesive means different from the first adhesive means, and the first adhesive means is at least one of a hardening adhesive and a hook and pile connector.

11. A towel dispenser for dispensing towel material in combination with a stack of material according to claim 1 further comprising:

at least one sensor for detecting any of the plurality of electronically readable markings integrated into or disposed on said towel material; and a control unit for controlling operation of the towel dispenser on the basis of the plurality of electronically readable markings sensed by any of the at least one sensor.

12. A towel dispenser according to claim 11, arranged for dispensing towel material in a loop from a roll or a stack, which towel dispenser has a back part and a cover part movably connected with the back part, wherein the cover part is provided with receiving means for receiving at least one roll or at least one stack of folded towel material and wherein the back part is provided with collecting means for receiving towel material dispensed from said at least one roll or said at least one stack.

13. A towel dispenser according to claim 12, wherein the cover part is hingedly connected with a portion of the back part facing down during use.

14. A towel dispenser according to claim 11 further comprising a drive unit having at least one brake mechanism and being at least partly pivotably connected with at least one of the back part and/or the cover part;

at least one sensor;

and a control unit that is coupled to the at least one sensor, wherein the at least one sensor is placed near a path of movement of the towel material and wherein the control unit is arranged for determining a dispensing pattern of towel material on the basis of the plurality of electronically readable markings sensed during use by any of the at least one sensor.

15. A towel dispenser according to claim 11 further comprising:

a holder for receiving at least one stack of folded towel material, the holder having a flap with a closing mechanism, which closing mechanism is provided with an overfill protection and wherein the collecting means includes a roller that is carried on a shaft, which is slidably received in a slot and is biased in a direction of a bottom of the slot, and wherein the roller is a freely rotatably bearing mounted on the shaft.

16. A strip of towel material according to claim 1, wherein the plurality of electronically readable markings includes at least one passive electronic circuit that is readable with a sensor sensitive to at least one of the plurality of electronically readable markings;

each of the plurality of electronically readable markings has at least two separate metal surfaces;

each of the plurality of electronically readable markings is disposed on a sheet that is disposed on the strip and wherein said sheet is self-adhesive; and said towel material is provided with a series of discrete markings that are spaced apart in the longitudinal direction and wherein the discrete markings are preferably arranged in a regular pattern that is integrated into or disposed on the towel material.

17. A set of strips of towel material according to claim 16, wherein at least some of the strips have been folded in a same manner but differ from each other in the plurality of electronically readable markings applied thereto, and wherein any of the plurality of electronically readable markings is preferably distinguished by at least one of their mutual distance, their position, their shape, and their nature.

18. A stack of towel material folded from a strip according to claim 16, wherein the stack has a top side and a bottom side, having a first end and a second end of the strip, respectively, wherein at least one of the first end and the second end is provided with a fastening strip connected with the first end by a first connection, on which fastening strip at least one of an adhesive layer and a hook and pile connector has been provided, while on the other of the first end and second end an adhesive strip may be provided for adhesion with the at least one adhesive layer and hook and pile connector on a fastening strip of a second stack.

19. A stack of towel material according to claim 18, wherein the fastening strip is provided with a folding part which is foldable over at least one of the adhesive layer and the hook and pile connector.

20. A stack of towel material according to claim 9, wherein at least one of the fastening strip and the adhesive strip is fixedly attached with the strip of towel material using a first adhesive means, the adhesive layer is designed in a second adhesive means different from the first adhesive means, and the first adhesive means is at least one of hardening adhesive and a hook and pile connector.

21. A stack of towel material according to claim 19, wherein at least one of the fastening strip and/or the adhesive strip are fixedly attached to the strip of towel material using a first adhesive means, the adhesive layer is designed in a second adhesive means different from the first adhesive means, and the first adhesive means is at least one of hardening adhesive and a hook and pile connector.

22. A towel dispenser according to claim 13 further comprising:

a drive unit having at least one brake mechanism and being pivotably connected with at least one of the back part the cover part;

at least one sensor; and a control unit that is coupled to the at least one sensor, wherein the sensor is disposed near a path of movement of the towel material, and wherein the control unit is arranged for determining a dispensing pattern of towel material on the basis of any of the plurality of electronically readable markings sensed by any of the at least one sensor during use; and a holder for receiving at least one stack of folded towel material having a flap with a closing mechanism, which closing mechanism is provided with an overfill protection, and wherein the collecting means includes a roller that is carried on a shaft, which is slidably received in a slot and is biased in a direction of a bottom of the slot, and the roller is a freely rotatably bearing mounted on the shaft.

* * * * *